US011788292B1

(12) United States Patent
Burzynski et al.

(10) Patent No.: US 11,788,292 B1
(45) Date of Patent: Oct. 17, 2023

(54) DUAL STRIP PROTECTIVE EDGE FILM FOR ROOFING MEMBRANE SEAMS

(71) Applicant: CARLISLE CONSTRUCTION MATERIALS, LLC, Carlisle, PA (US)

(72) Inventors: Adam Burzynski, Camp Hill, PA (US); David French, Carlisle, PA (US); Jordan Olivio, Carlisle, PA (US); Jesse Sutton, Carlisle, PA (US); Jacob Sandrock, Carlisle, PA (US)

(73) Assignee: CARLISLE CONSTRUCTION MATERIALS, LLC, Carlisle, PA (US)

( * ) Notice: Subject to any disclaimer, the term of this patent is extended or adjusted under 35 U.S.C. 154(b) by 0 days.

(21) Appl. No.: 18/136,647

(22) Filed: Apr. 19, 2023

Related U.S. Application Data

(60) Provisional application No. 63/351,946, filed on Jun. 14, 2022.

(51) Int. Cl.

| | |
|---|---|
| ***E04D 5/14*** | (2006.01) |
| *E04D 5/08* | (2006.01) |
| *E04D 5/06* | (2006.01) |

(52) U.S. Cl.
CPC ..... *E04D 5/142* (2013.01); *E04D 5/148* (2013.01); *E04D 5/149* (2013.01); *E04D 5/06* (2013.01); *E04D 5/08* (2013.01)

(58) Field of Classification Search
CPC ..... E04D 5/142; E04D 5/148; E04D 5/149; E04D 5/06; E04D 5/08
See application file for complete search history.

(56) References Cited

U.S. PATENT DOCUMENTS

| | | | | |
|---|---|---|---|---|
| 4,767,658 | A | 8/1988 | Lorenz | |
| 6,303,204 | B2 | 10/2001 | Mathieson | |
| 7,146,771 | B2 | 12/2006 | Swann | |
| 8,709,565 | B2 * | 4/2014 | Kalwara | E04D 5/148 52/309.1 |
| 8,833,037 | B2 * | 9/2014 | French | B32B 7/12 52/409 |
| 9,163,410 | B2 | 10/2015 | French et al. | |
| 9,212,488 | B1 | 12/2015 | McGraw et al. | |
| 10,422,138 | B1 | 9/2019 | French et al. | |
| 10,801,207 | B2 | 10/2020 | French et al. | |
| 2020/0270866 | A1 * | 8/2020 | Yancey | E04D 5/148 |
| 2022/0259813 | A1 | 8/2022 | Cannon | |

* cited by examiner

*Primary Examiner* — Patrick J Maestri
(74) *Attorney, Agent, or Firm* — David R. Heckadon; Gordon Rees Scully Mansukhani LLP

(57) ABSTRACT

A dual strip protective edge film system for a roofing membrane having a first protective edge film strip covering a top edge portion of the roofing membrane and a second protective edge film strip covering a top portion of the roofing membrane, wherein the second protective edge film strip is positioned in parallel next to the first protective edge film strip, and wherein both of the edge strips have a combined width approximately equal to the width of the overlap between two overlapping roofing membranes that are adhesively secured or thermally welded together.

18 Claims, 13 Drawing Sheets

DUAL STRIP PROTECTIVE EDGE FILM FOR ROOFING MEMBRANE SEAMS

RELATED APPLICATION

The present application claims priority to U.S. Provisional Patent Application Ser. No. 63/351,946 of same title, filed Jun. 14, 2022, the entire disclosure of which is incorporated herein by reference in its entirety for all purposes.

TECHNICAL FIELD

The present invention relates to systems for attaching the overlapping edges of roofing membranes together using adhesives or thermal welding, solvent welding, mechanical seaming, etc. In addition, the present invention relates both to systems that use mechanical fasteners to attach the roofing membranes onto the roof and to systems that do not use mechanical fasteners to attach the roofing membranes onto the roof (for example adhered, induction welded, hook and loop systems, etc.).

BACKGROUND OF THE INVENTION

When splicing two sheets of overlapping roofing membranes (e.g.: membranes made of TPO, PVC, EPDM, etc.) together using adhesives or heat, it is critical that the seam area surfaces first be clean. Dust, dirt, debris, and adhesive overspray or splatter often get onto the seam area of the membrane, which can interfere with the splicing together of the membranes. This results in the need to clean the area prior to splicing together the membranes when using either adhesive or thermal bonding. If left uncleaned, the installer is often unable to properly adhere or thermally weld the overlapping edges of the two overlapping membranes together. What is instead desired is a system to keep these membrane edges clean and free of debris until they are ready to be adhesively or thermally fastened together.

In addition, mechanical fasteners are often used to secure the edges of the roofing membranes to the roof itself. Accordingly, installers need to complete the mechanical fastening to the roof while also ensuring that these membrane edges do not get dirty. This can be difficult. Therefore, any new system for working with mechanical fasteners at these edges must also keep the edges of the membranes clean and free of dirt and debris prior to adhesive or thermal bonding.

SUMMARY OF THE INVENTION

In accordance with the present system, a dual strip protective edge film system is provided for a roofing membrane. This system comprises: a roofing membrane; a first protective edge film strip covering a top edge portion of the roofing membrane and a second protective edge film strip also covering a top portion of the roofing membrane. The second protective edge strip is positioned in parallel next to the first protective edge strip and may be formed from the same material and optionally be separated by a perforation. An optional bottom protective strip may also be included at the edge of the overlapping top membrane. Both of these edges strips are positioned next to one another at the side edge of the roofing membrane. In preferred embodiments, the roofing membrane may be EPDM, TPO, PVC or other suitable single ply material. In optional embodiments, indicia markings may also be provided on the roofing membrane to assist in aligning the overlapping membranes with one another prior to attaching them together. In additional preferred embodiments, the protective strip film may be translucent or transparent such that the indicia marks can be seen therethrough.

Preferably, each of the first and second protective edge strips are between 1.5 to 4 inches wide and are positioned side-by-side at the edges of the roofing membrane. The first and second protective edge strips may be peeled off together, or may be peeled off one at a time in either order. As will be shown, the present dual strip design advantageously permits a number of different methods in which the present system can be used to keep the edges of the membrane clean and debris free immediately before adhesively or thermally attaching a second membrane on top of the first membrane. In addition, as will be shown, the present system can be used both with, and without, mechanical plates and fasteners also connecting the roofing membranes to the roof. Moreover, indicia marks can be visible through a translucent (or transparent) protective edge strip to allow for proper alignment between the two sheets of material being spliced together.

In a first preferred method of using the present system, both the first and second protective edge film strips are removed together and then the top membrane is adhered or thermally welded thereover.

In a second preferred method of using the present system, the first strip of protective edge film (i.e.: the one right at the side edge of the membrane) is removed to permit the installer to first use mechanical plates and fasteners to secure the bottom membrane to the roof below. At this time, the second edge strip remains on the membrane and keeps the area adjacent to the plates and fasteners clean and free of debris. After the user has then finished installing the mechanical plates and fasteners, (s)he then removes the second edge strip and then adheres or thermally welds the two membranes together in the area protected by the second edge strip. The advantage of this approach is that the area under the second edge strip is kept clean until after the work with the mechanical plates and fasteners has been completed.

In a third preferred method of using the present system, the first edge strip is left in place and the installer simply installs the mechanical plates and fasteners through the first edge strip, thereby securing the membrane edge to the roof below. After the installer has finished installing the mechanical plates and fasteners, (s)he then removes the second edge strip and then adheres or thermally welds the two membranes together. The advantage of this approach is that the area under the second edge strip is kept clean until after the work with the mechanical plates and fasteners has been completed. In this case, the first edge strip is simply compressed between the overlapping edges of the adhesively bonded or thermally welded together edge membranes with the splicing process.

In optional preferred aspects, indicia are provided on top of the membrane or on the top of the protective edge strips, or both. These indicia can be used to assist in aligning the overlapping edges of the two roofing membranes before they are adhesively bonded or thermally welded together. These indicia may optionally be placed at various locations on or under each of the first and second edge strips. For example, the indicia may be placed on top of the protective strip(s), or below the edges where the first and second protective edge strips contact one another, or below the center of the first edge strip, or at an inward edge of the second protective edge strip, or at other suitable locations. In optional preferred aspects, the edge strip(s) can be translucent or transparent such that indicia marks can be viewed therethrough.

Preferably, the first and second edge strips are factory laminated or otherwise bonded to the seam (i.e.: edge) area of the membrane panel to keep this area free from dirt and dust during installation. These edge strips allow for the application of adhesive to the membrane or adjacent substrate without concern for contamination or overspray on to the seam area.

In optional embodiments, the first and second edge strips may either be separate strips of material or they may optionally be made of one wide strip of material that is separated into first and second strips by a perforation running therebetween. In optional preferred aspects, each of the first and second edge strips can be between 1.5 inches to 4 inches wide.

BRIEF DESCRIPTION OF THE DRAWINGS

FIG. 1 shows two roofing membranes with the overlapping edge of the top membrane flipped up.

FIG. 2 shows the first and second protective edge strips being simultaneously pulled off the edge of the bottom roofing membrane.

FIG. 3 shows a protective edge strip being removed from a bottom edge of the top membrane.

FIG. 4 shows the edge of the top membrane being placed over the edge of the bottom membrane.

FIG. 5 shows the first edge strip being removed from the bottom membrane.

FIG. 6 shows mechanical plates and fasteners being used to connect the bottom membrane to the roof therebelow.

FIG. 7 shows the second edge strip being removed from the bottom membrane.

FIG. 8 shows a protective edge strip being removed from the bottom edge of the top membrane.

FIG. 9 shows the edge of the top membrane being placed over the edge of the bottom membrane.

FIG. 10 shows mechanical plates and fasteners being used to connect the bottom membrane to the roof therebelow with the first edge strip not being removed from the bottom membrane such that the mechanical fasteners pass through the first edge strip.

FIG. 11 shows the second edge strip being removed from the bottom membrane.

FIG. 12 shows a protective edge strip being removed from the bottom edge of the top membrane.

FIG. 13 shows the edge of the top membrane being placed over the edge of the bottom membrane.

DETAILED DESCRIPTION OF THE DRAWINGS

The present system provides a dual strip protective edge film system for a roofing membrane, comprising: a roofing membrane; a first protective edge strip covering a top edge portion of the roofing membrane; and a second protective edge strip covering a top portion of the roofing membrane. The second protective edge strip is positioned in parallel next to the first protective edge strip. Both the first and second edge strips are positioned at or close to the edge of the roofing membrane in the region where the roofing membrane is attached to the edge of an adjacent overlapping roofing membrane. As such, the width of the first and second edge strips together is preferably from one half to the full amount of the overlap width of the two overlapping membranes.

The present invention also includes at least three different methods of using the present system. The methods will first be described below followed by a description of the apparatus itself. In this regard, FIGS. 1 to 4 illustrate a first preferred method of using the present system; FIGS. 5 to 9 illustrate a second preferred method of using the present system and FIGS. 10 to 13 illustrate a third preferred method of using the present system, as follows:

FIGS. 1 to 4 illustrate sequential steps in a first method of splicing two roofing membranes 10 and 20 together with one of the roofing membranes 10 having the present dual strip protective edge film thereon as follows.

Figure 1:
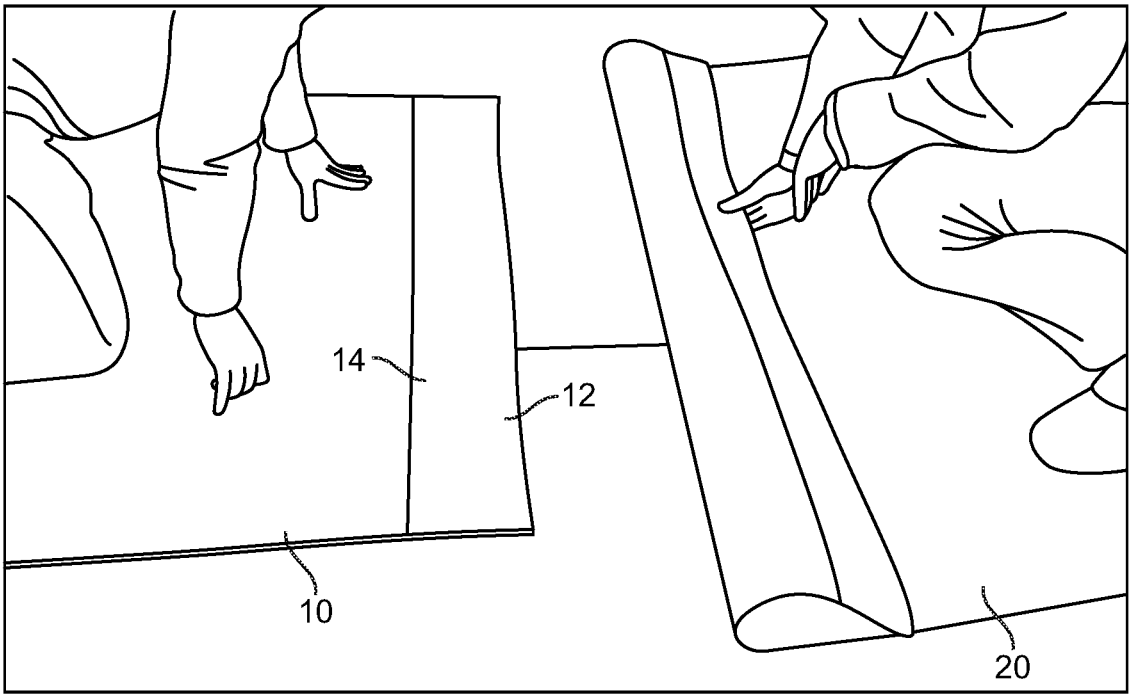
FIGS. 1 to 4 illustrate sequential steps in a first method of splicing (i.e.: joining) two roofing membranes together with one of the roofing membranes having the present dual strip protective edge film thereon, as follows.

First, FIG. 1 shows two roofing membranes 10 and 20 with the overlapping edge of the top membrane 20 flipped up.

Figure 2:
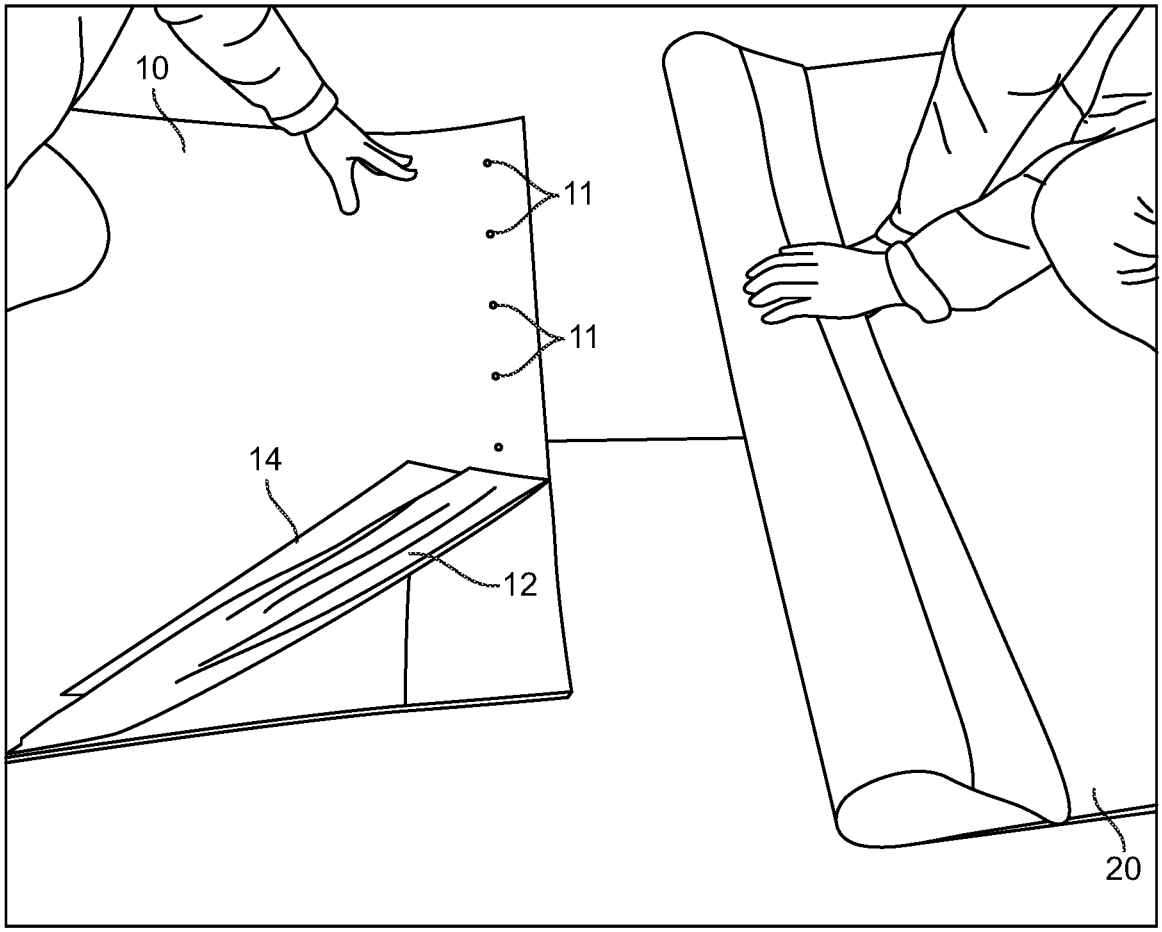

Next, FIG. 2 shows the first and second edge strips 12 and 14 being simultaneously pulled off the top edge of bottom roofing membrane 10.

Figure 3:
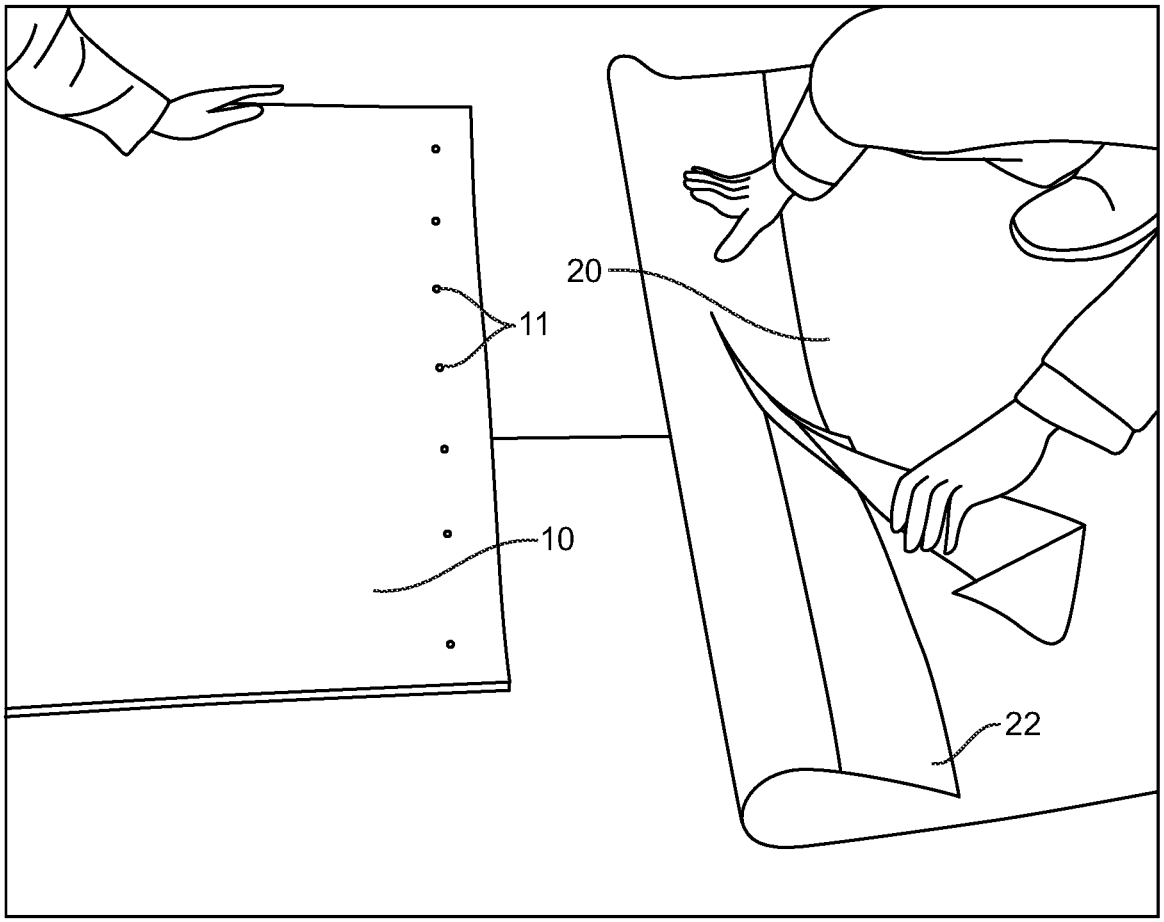

Next, FIG. 3 shows a protective edge strip 22 being removed from the bottom edge of top membrane 20.

Figure 4:
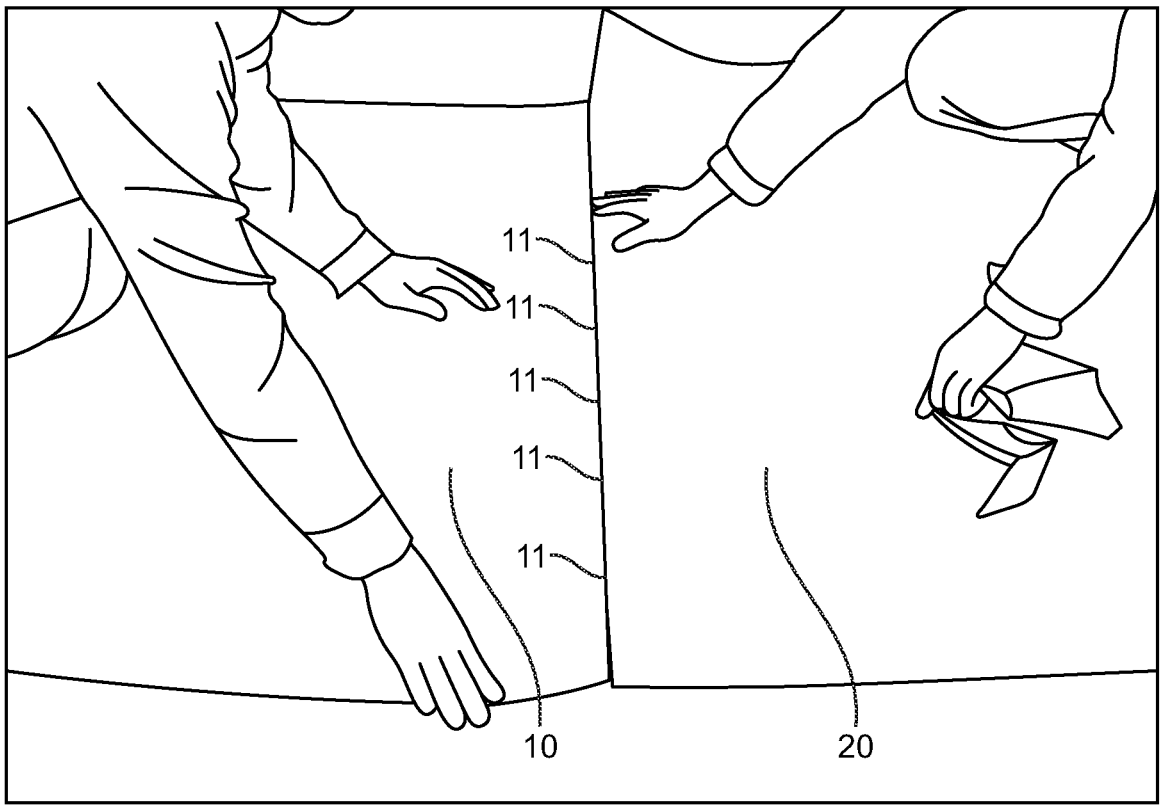

Finally, FIG. 4 shows the edge of top membrane 20 being placed over the edge of bottom membrane 10. At this time, the overlapping edges can then be adhesively bonded or thermally welded together.

In this preferred method, the areas under protective strips 12 and 14 are advantageously kept clean and free of debris until the adhesives or heat for thermal bonding is applied.

In optional preferred aspects, indicia marks 11 run along the top surface of bottom membrane 10 such that the side edge of top membrane 20 can be placed thereover in alignment. In the illustrated embodiment, indicia marks 11 are located immediately below the center of first strip 12. It is to be understood, however, that indicia 11 can also be placed at the innermost edge of protective edge strips 12 or 14, or at any other convenient location, all keeping within the scope of the present invention.

Figure 5:
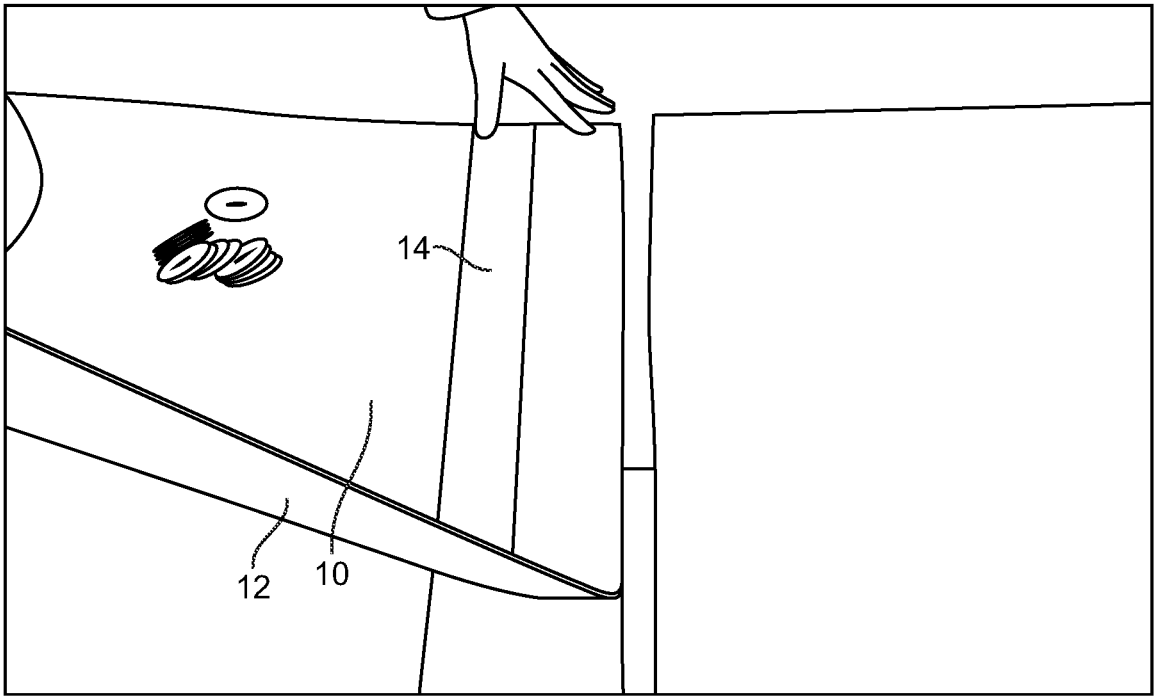
FIGS. 5 to 9 illustrate sequential steps in a second method of splicing (i.e.: joining) two roofing membranes together with one of the roofing membranes having the present dual edge strip thereon, as follows.

FIGS. 5 to 9 illustrate sequential steps in a second method of splicing roofing membranes 10 and 20 together with roofing membrane 10 having the present dual strip protective edge film thereon, as follows:

First, FIG. 5 shows the first edge strip 12 being removed from bottom membrane 10.

Figure 6:
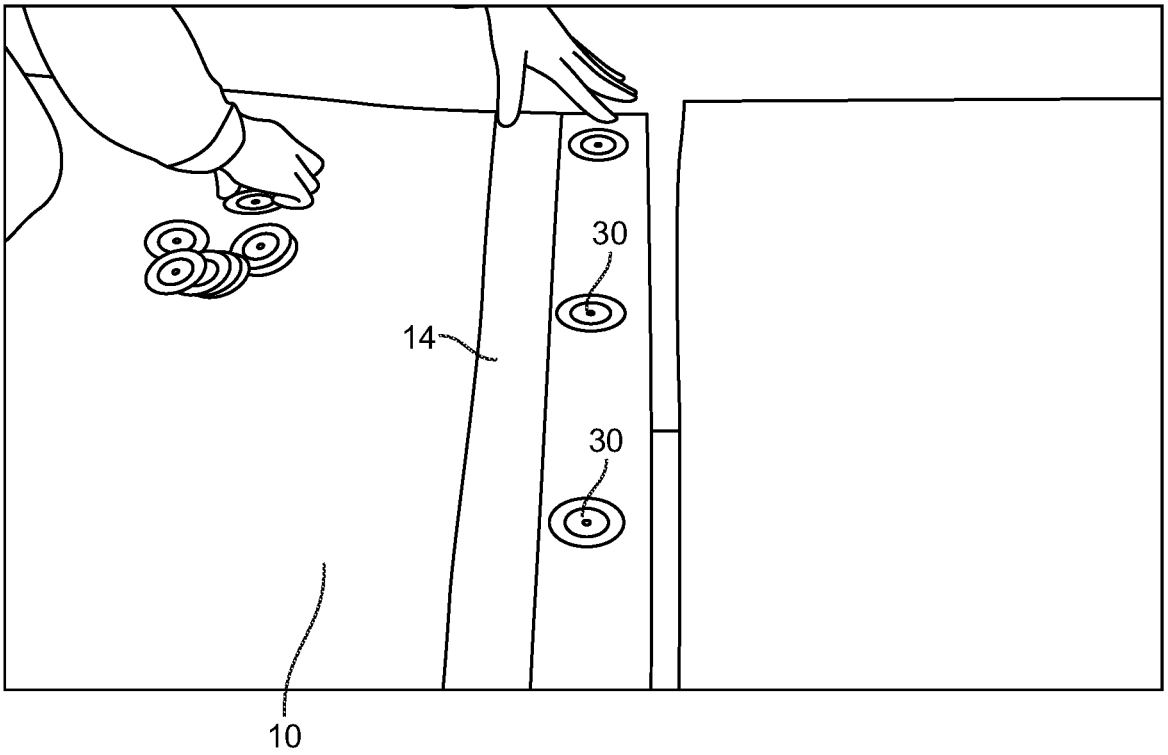

Next, FIG. 6 shows mechanical plates and fasteners 30 being used to connect the bottom membrane 10 to the roof therebelow. As can be seen, fasteners 30 can optionally be aligned with indicia 11.

Figure 7:
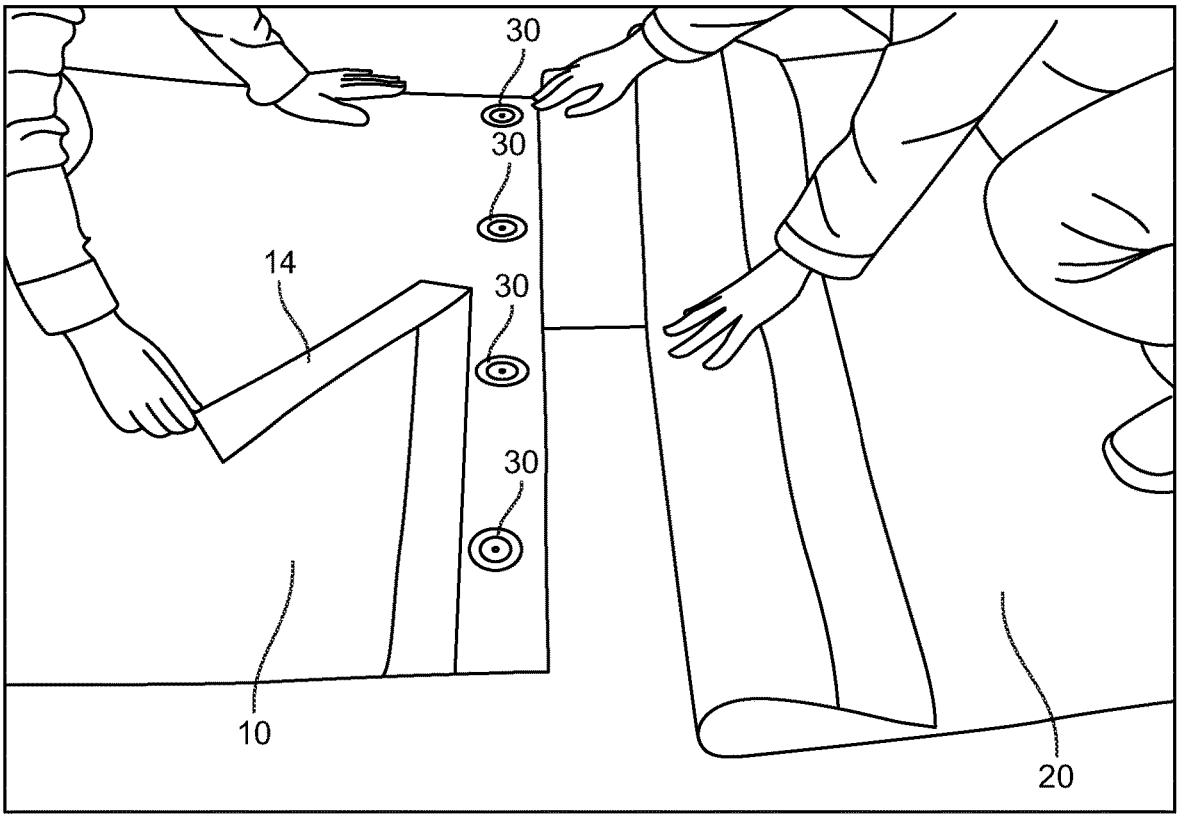

Next, FIG. 7 shows the second edge strip 14 being removed from bottom membrane 10.

Figure 8:
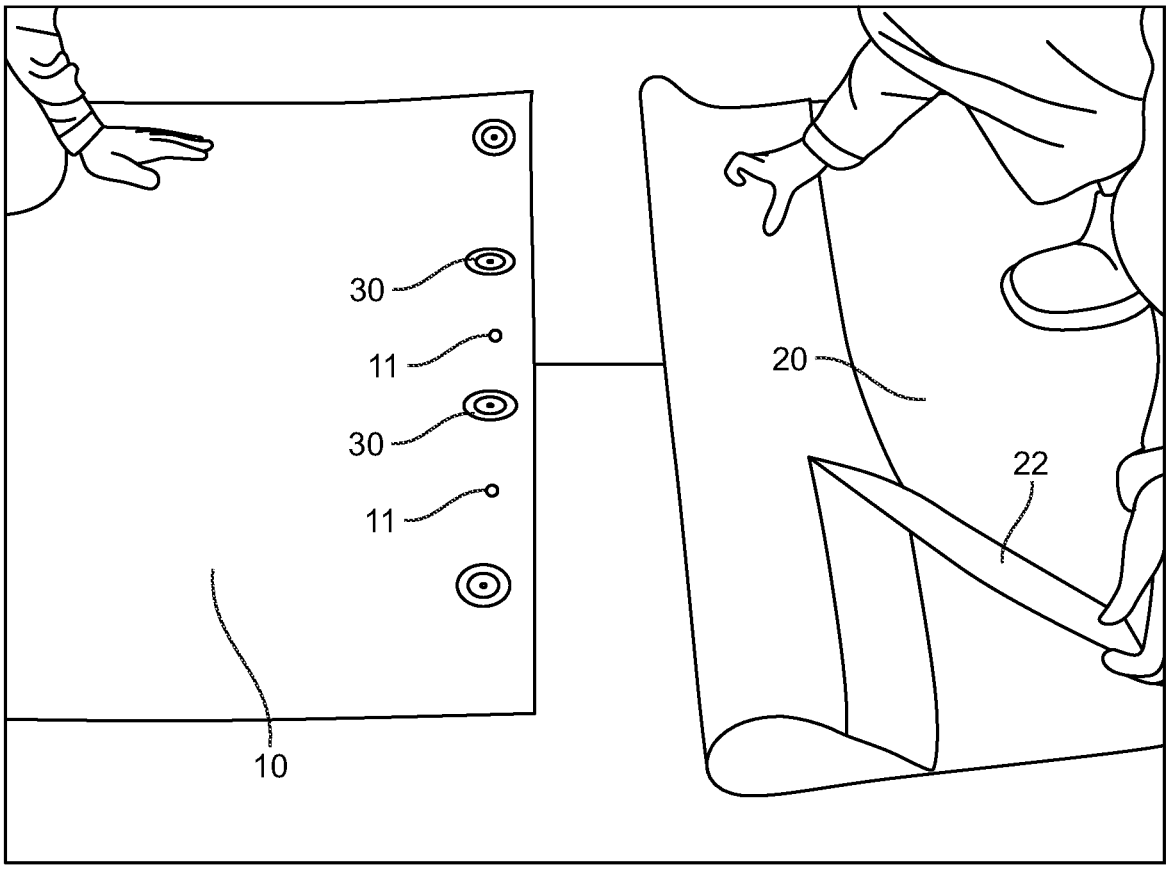

Next, FIG. 8 shows a protective edge strip 22 being removed from the bottom edge of top membrane 20.

Figure 9:
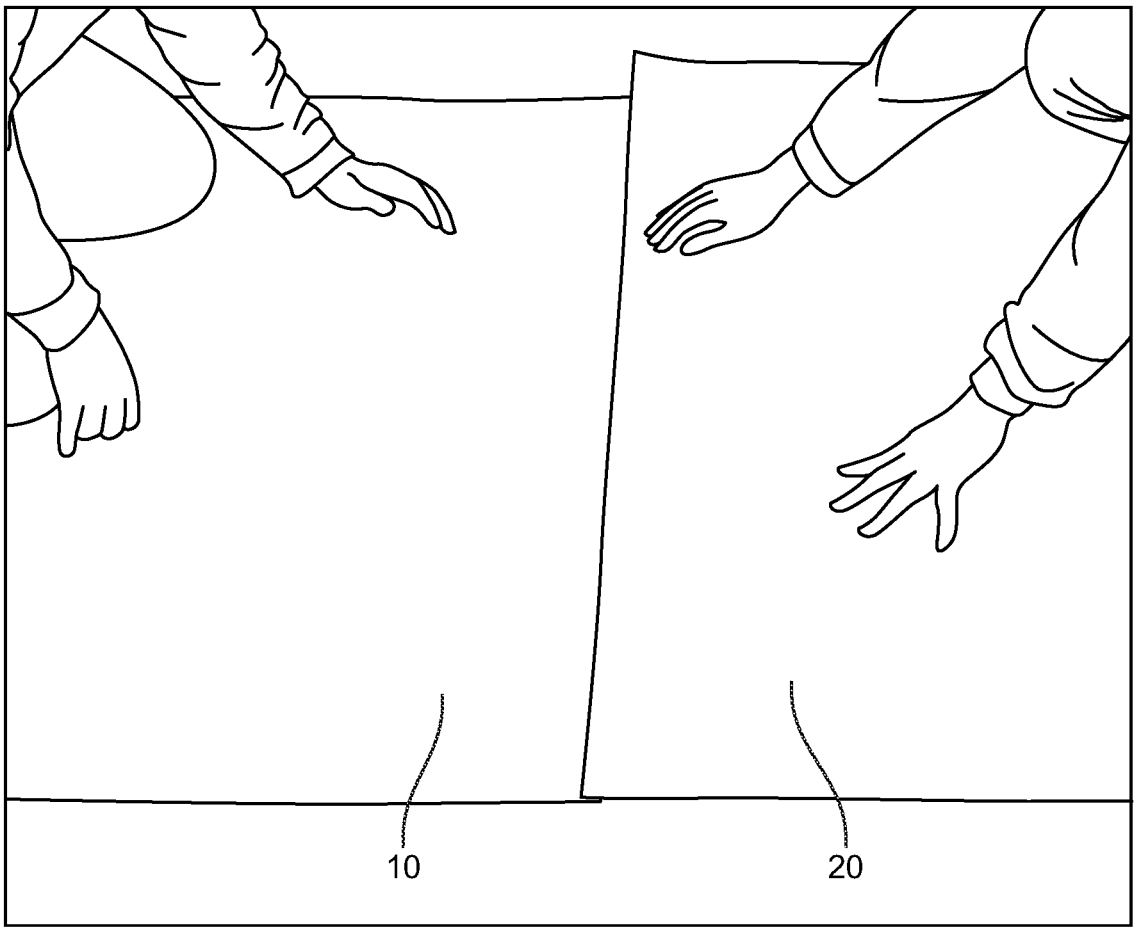

Next, FIG. 9 shows the edge of top membrane 20 being placed over the edge of bottom membrane 10. At this time, the overlapping edges can then be adhesively bonded or thermally welded together. Optionally, alignment marks or indicia on the top of bottom membrane 10 can be used to position top membrane 20. For example, indicia at the innermost edge of second protective strip 14 can be used.

In this second preferred method, the areas under protective strip 14 are advantageously kept clean and free of debris until the adhesives or thermal bonding is applied. The area under edge strip 12 was also kept clean right up until plates and fasteners 30 were installed on the area previously covered by protective strip 12. In this second method, protective strip 12 may be translucent or transparent such that indicia marks 11 can be seen therethrough.

Figure 10:
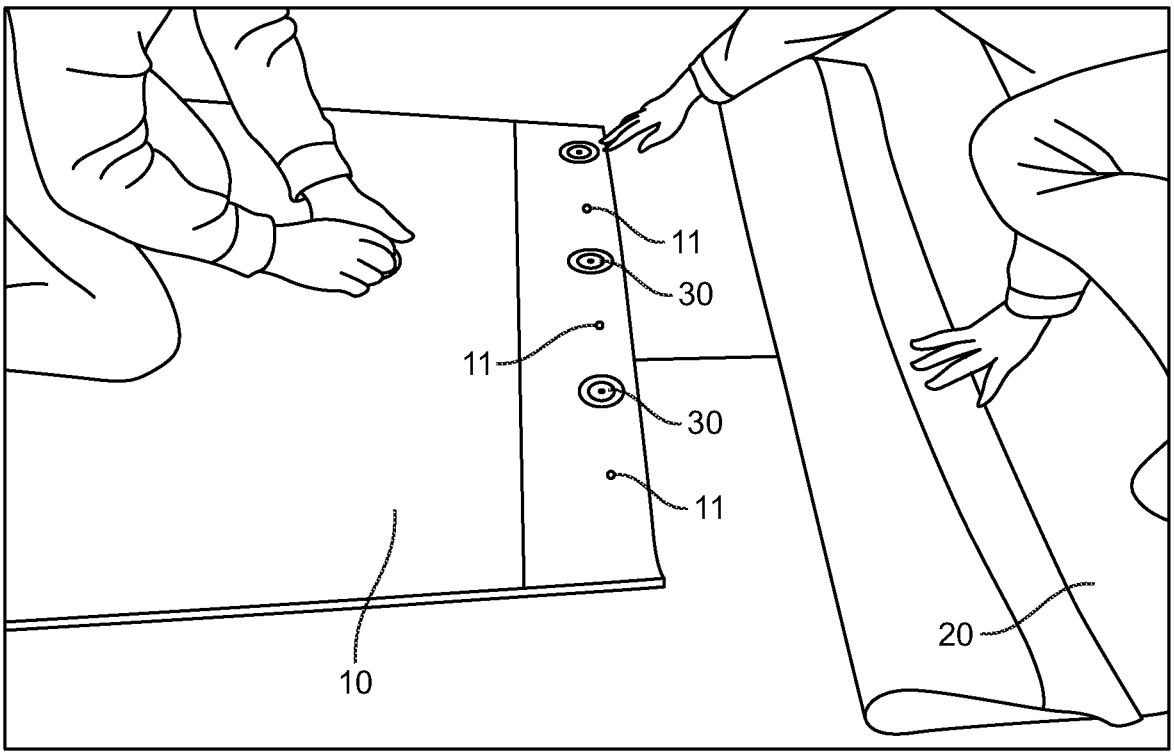
FIGS. 10 to 13 illustrate sequential steps in a third method of splicing two roofing membranes together with one of the roofing membranes having the present dual strip protective edge film thereon, as follows.

FIGS. 10 to 13 illustrate sequential steps in a third method of splicing two roofing membranes together with one of the roofing membranes having the present dual strip protective edge film thereon, as follows:

FIG. 10 shows mechanical plates and fasteners 30 being used to connect bottom membrane 10 to the roof below with the first edge strip 12 not being removed from bottom membrane 10 such that mechanical fasteners 30 pass directly through first edge strip 12.

Figure 11:
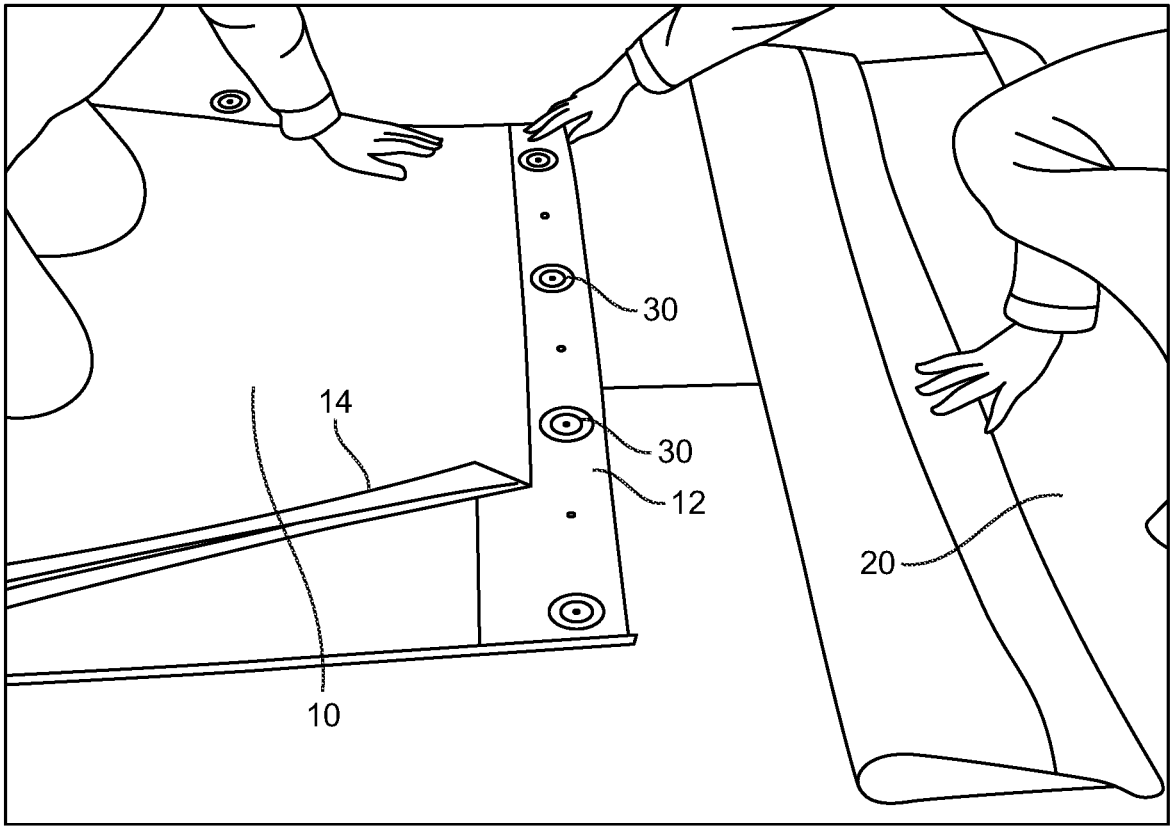

FIG. 11 shows the second edge strip 14 being removed from the bottom membrane. The advantage of removing strip 14 at this time is that the area under edge strip 14 is then first exposed after the installer has finished installing fasteners 30, thereby keeping the area under strip 14 clean. Strip 12 can optionally be translucent or transparent such that indicia marks 11 can be seen therethrough.

Figure 12:
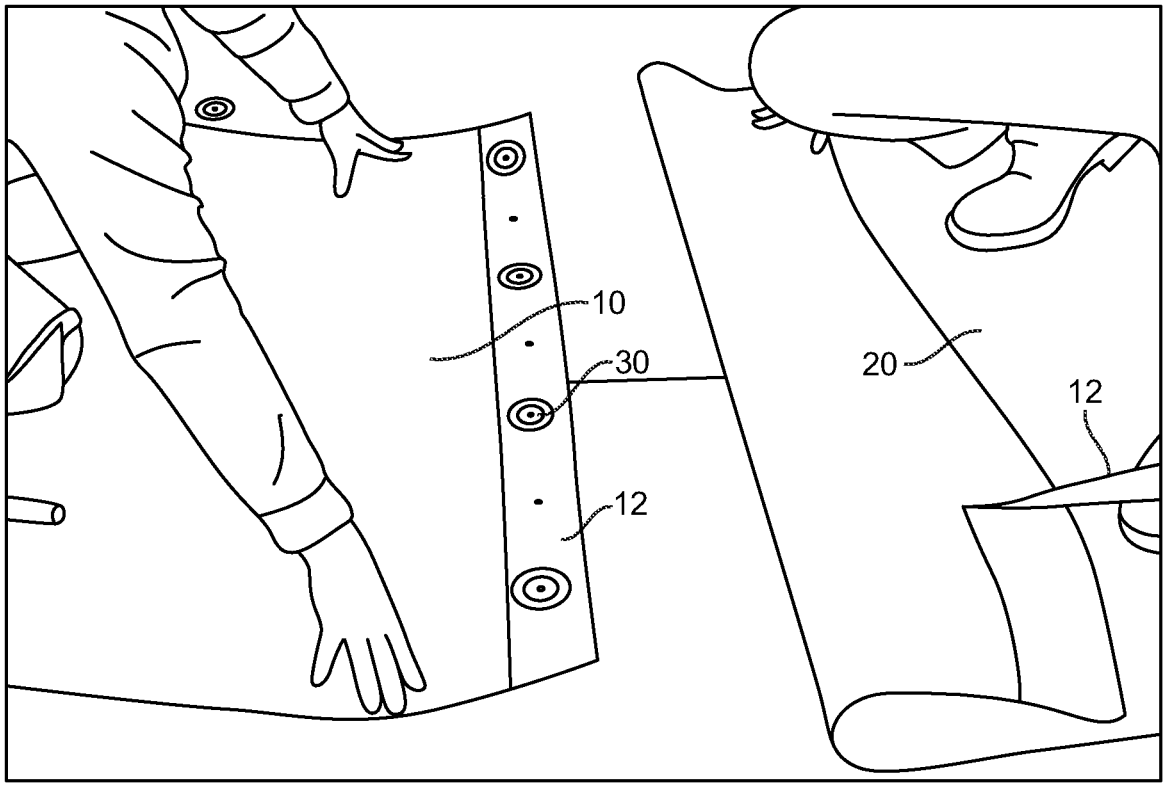

FIG. 12 shows a protective edge strip 22 being removed from the bottom edge of top membrane 20.

Figure 13:
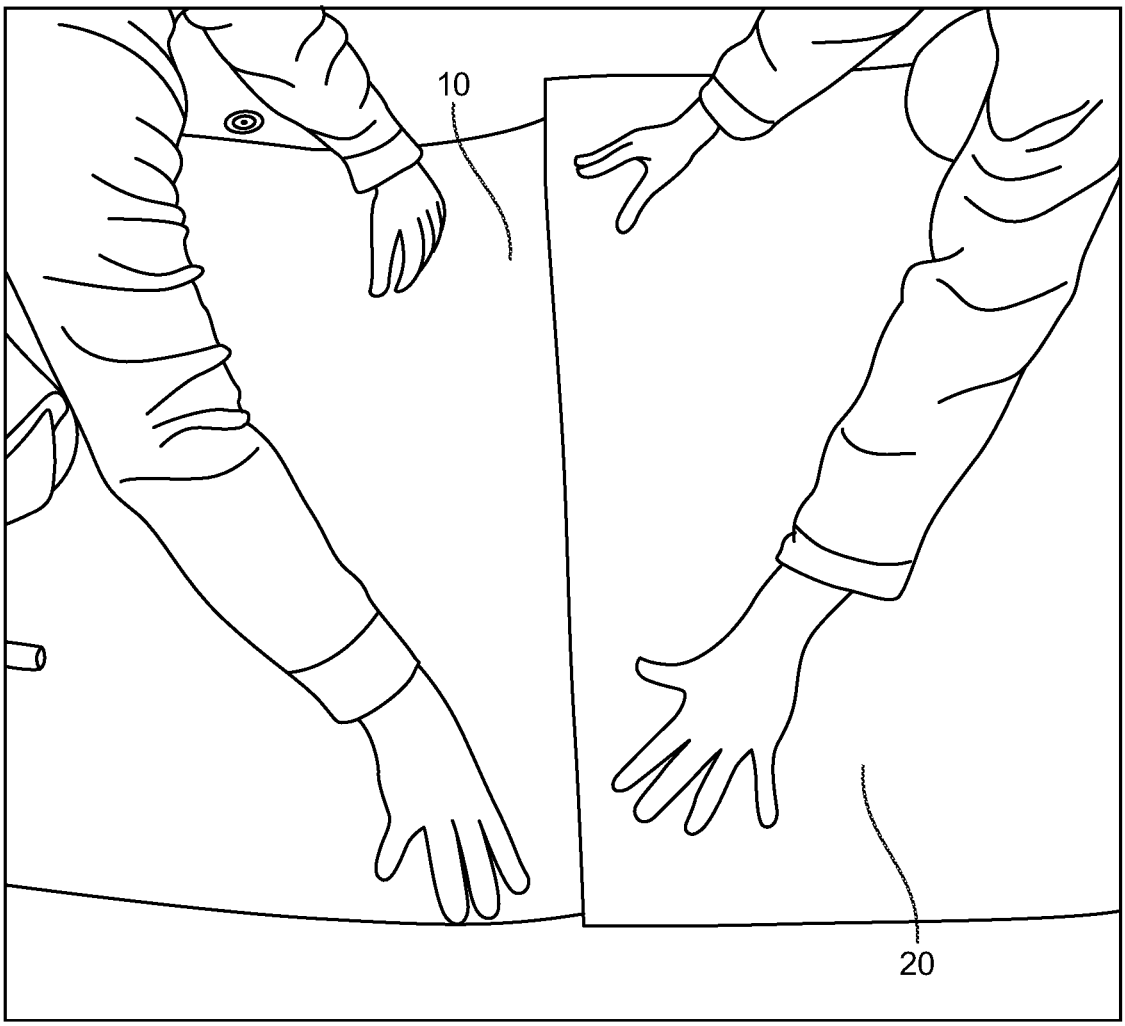

Lastly, FIG. 13 shows the edge of top membrane 10 being placed over the edge of bottom membrane 20, ready to adhere or thermally weld the two membranes together. Optional indicia marks on the top of bottom membrane 10 may be used to properly align the side edge of top membrane 20 over bottom membrane 10.

In preferred aspects, the present apparatus comprises a dual strip protective edge film system for a roofing membrane, comprising: a roofing membrane 10; a first protective edge film strip 12 covering a top edge portion of the roofing membrane; and a second protective edge film strip 14 covering a top portion of the roofing membrane, wherein the second protective edge film strip 14 is positioned in parallel next to the first protective edge film strip 12. Roofing membrane 10 (and 20) may be made of EPDM, TPO, PVC or other suitable material.

The first and second edge strips 12 and 14 may be formed from the same sheet of material, but separated by a perforation therebetween. Preferably, each of the first and second edge strips are between 1.5 to 4 inches wide, but the present system isn't limited to any particular dimensions.

What is claimed is:

1. A dual strip protective edge film system for a roofing membrane, comprising:

a roofing membrane having a first edge on one side of the roofing membrane and a second edge on an opposite side of the roofing membrane;

a first protective edge film strip covering a top edge portion of the roofing membrane; and a second protective edge film strip covering a top portion of the roofing membrane, wherein the second protective edge film strip is positioned in parallel next to the first protective edge film strip, wherein the first protective edge film strip and the second protective edge film strip are positioned together side-by-side at the same edge of the roofing membrane, and wherein the second edge of the roofing membrane is free of edge strips.

2. The system of claim 1, wherein the roofing membrane is made of EPDM, TPO or PVC.

3. The system of claim 1, further comprising:

a second roofing membrane with a protective edge film strip covering a bottom portion of the second roofing membrane.

4. The system of claim 1, wherein the first and second protective edge film strips are formed from the same sheet of material but are separated by a perforation therebetween.

5. The system of claim 1, wherein each of the first and second protective edge film strip is between 1.5 to 4 inches wide.

6. A dual strip protective edge film system for a roofing membrane, comprising:

a roofing membrane;

a first protective edge film strip covering a top edge portion of the roofing membrane; and a second protective edge film strip covering a top portion of the roofing membrane, wherein the second protective edge film strip is positioned in parallel next to the first protective edge film strip, wherein the first protective edge strip is translucent or transparent.

7. A dual strip protective edge film system for a roofing membrane, comprising:

a roofing membrane;

a first protective edge film strip covering a top edge portion of the roofing membrane; and a second protective edge film strip covering a top portion of the roofing membrane, wherein the second protective edge film strip is positioned in parallel next to the first protective edge film strip, further comprising indicia markings on the roofing membrane.

8. The system of claim 7, wherein the indicia markings are located below a side edge of the first protective edge film strip and a side edge of the second protective edge film strip where the side edge of the first protective edge film strip and the side edge of the second protective edge film strips contact one another.

9. The system of claim 7, wherein the indicia markings are located below a center of the first protective edge film strip.

10. The system of claim 7, wherein the indicia markings are located at an inward edge of the second protective edge film strip.

11. A method of sealing two roofing membranes together by:

providing a top roofing membrane;

providing a bottom roofing membrane having:

a first protective edge film strip covering a top edge portion of the bottom roofing membrane; and a second protective edge film strip covering a top portion of the bottom roofing membrane, wherein the second protective edge film strip is positioned in parallel next to the first protective edge film strip, wherein the first protective edge film strip and the second protective edge film strip are positioned together side-by-side at the same edge of the bottom roofing membrane;

removing the first and second protective edge film strips from the bottom roofing membrane;

aligning the top roofing membrane and the bottom roofing membrane; and then adhering or thermally welding the top roofing membrane and the bottom roofing membrane together.

12. The method of claim 11, further comprising:

removing a third protective edge strip from the bottom of the top roofing membrane.

13. A method of sealing two roofing membranes together by:

providing a top roofing membrane;

providing a bottom roofing membrane having:

a first protective edge film strip covering a top edge portion of the bottom roofing membrane; and a second protective edge film strip covering a top portion of the bottom roofing membrane, wherein the second protective edge film strip is positioned in parallel next to the first protective edge film strip, and wherein the first protective edge film strip and the second protective edge film strip are positioned together side-by-side at the same edge of the roofing membrane;

removing the first and second protective edge film strips from the bottom roofing membrane;

aligning the top roofing membrane and the bottom roofing membrane; and then adhering or thermally welding the top and bottom roofing membranes together, wherein aligning the top roofing membrane and the bottom roofing membrane comprises:

aligning an edge of the top roofing membrane with alignment indicia on the bottom roofing membrane.

14. A method of sealing two roofing membranes together by:

providing a top roofing membrane;

providing a bottom roofing membrane having:

a first protective edge film strip covering a top edge portion of the bottom roofing membrane; and a second protective edge film strip covering a top portion of the bottom roofing membrane, wherein the second protective edge film strip is positioned in parallel next to the first protective edge film strip, and wherein the first protective edge film strip and the second protective edge film strip are positioned together side-by-side at the same edge of the bottom roofing membrane;

removing the first protective edge film strip from the bottom roofing membrane;

mechanically fastening the bottom roofing membrane onto a roof;

removing the second protective edge film strip from the bottom roofing membrane;

aligning the top roofing membrane and the bottom roofing membrane; and then adhering or thermally welding the top roofing membrane and the bottom roofing membrane together.

15. A method of sealing two roofing membranes together by:

providing a top roofing membrane;

providing a bottom roofing membrane having:

a first protective edge film strip covering a top edge portion of the bottom roofing membrane; and a second protective edge film strip covering a top portion of the bottom roofing membrane, wherein the second protective edge film strip is positioned in parallel next to the first protective edge film strip;

removing the first protective edge film strip from the bottom roofing membrane;

mechanically fastening the bottom roofing membrane onto a roof;

removing the second protective edge film strip from the bottom roofing membrane;

aligning the top roofing membrane and the bottom roofing membrane; and then adhering or thermally welding the top and bottom roofing membranes together, wherein aligning the top and bottom roofing membranes comprises:

aligning an edge of the top roofing membrane with alignment indicia on the bottom roofing membrane.

16. A method of sealing two roofing membranes together by:

providing a top roofing membrane;

providing a bottom roofing membrane having:

a first protective edge film strip covering a top edge portion of the roofing membrane; and a second protective edge film strip covering a top portion of the roofing membrane, wherein the second protective edge film strip is positioned in parallel next to the first protective edge film strip, and wherein the first protective edge film strip and the second protective edge film strip are positioned together side-by-side at the same edge of the bottom roofing membrane;

mechanically fastening the bottom roofing membrane onto a roof;

removing the second protective edge film strip from the bottom roofing membrane;

aligning the top roofing membrane and the bottom roofing membrane; and then adhering or thermally welding the top roofing membrane and the bottom roofing membrane together.

17. A method of sealing two roofing membranes together by:

providing a top roofing membrane;

providing a bottom roofing membrane having:

a first protective edge film strip covering a top edge portion of the bottom roofing membrane; and a second protective edge film strip covering a top portion of the bottom roofing membrane, wherein the second protective edge film strip is positioned in parallel next to the first protective edge film strip;

mechanically fastening the bottom roofing membrane onto a roof;

removing the second protective edge film strip from the bottom roofing membrane;

aligning the top roofing membrane and the bottom roofing membrane; and then adhering or thermally welding the top and bottom roofing membranes together, wherein aligning the top and bottom roofing membranes comprises:

aligning an edge of the top roofing membrane with alignment indicia on the bottom roofing membrane.

18. The method of claim 13, wherein the alignment indicia are located:

below side edges of the first and second protective edge film strips where the side edges of the first and second protective edge film strips contact one another, below the center of the first protective edge film strip, or at an inward edge of the second protective edge film strip.

* * * * *